US010960516B2

(12) United States Patent
Grutza et al.

(10) Patent No.: US 10,960,516 B2
(45) Date of Patent: Mar. 30, 2021

(54) ABRADING TOOLS AND METHODS OF MAKING SAME

(71) Applicant: DI-COAT CORPORATION, Novi, MI (US)

(72) Inventors: Joshua Grutza, Novi, MI (US); Zigmund R. Grutza, Novi, MI (US); David Asselin, Lambertville, MI (US); Alan Davis, Canton, MI (US)

(73) Assignee: Di-Coat Corporation, Novi, MI (US)

( * ) Notice: Subject to any disclaimer, the term of this patent is extended or adjusted under 35 U.S.C. 154(b) by 923 days.

(21) Appl. No.: 15/205,887

(22) Filed: Jul. 8, 2016

(65) Prior Publication Data

US 2016/0318156 A1 Nov. 3, 2016

Related U.S. Application Data

(63) Continuation of application No. 14/075,490, filed on Nov. 8, 2013.

(60) Provisional application No. 61/724,487, filed on Nov. 9, 2012.

(51) Int. Cl.
*B24D 18/00* (2006.01)
*B24D 5/06* (2006.01)

(52) U.S. Cl.
CPC ..... *B24D 18/0072* (2013.01); *B24D 5/063* (2013.01); *B24D 18/0018* (2013.01)

(58) Field of Classification Search
CPC ..... B24D 11/001; B24D 18/0018; B24D 18/0072; B24D 5/063
USPC ..... 451/527, 539, 540
See application file for complete search history.

(56) References Cited

U.S. PATENT DOCUMENTS

| | | | | |
|---|---|---|---|---|
| 1,573,961 | A | | 2/1926 | Zucker |
| 2,049,324 | A | | 7/1936 | Schneider |
| 4,047,902 | A | | 9/1977 | Wiand |
| 4,133,146 | A | | 1/1979 | De Cola |
| 4,826,508 | A | | 5/1989 | Schwartz et al. |
| 4,874,478 | A | | 10/1989 | Ishak et al. |
| 5,015,266 | A | | 5/1991 | Yamamoto |
| 5,318,604 | A | | 6/1994 | Gorsuch et al. |
| 5,332,098 | A | * | 7/1994 | Fisher ..... B24B 23/02 206/374 |
| 5,363,530 | A | | 11/1994 | Dunn et al. |
| 5,389,119 | A | | 2/1995 | Ferronato et al. |

(Continued)

*Primary Examiner* — Monica S Carter
*Assistant Examiner* — Marcel T Dion
(74) *Attorney, Agent, or Firm* — Carrier Blackman & Associates, P.C.; Willam D. Blackman; Joseph P. Carrier

(57) ABSTRACT

An abrading tool includes a base member having a support portion defining a first level, and a plurality of integral raised islands extending upwardly above the first level. The base member may be formed of metal or a non-conductive material. The islands are spaced apart from one another. Each island includes a respective tip portion. The distance between adjacent islands may be greater than the width of a single island. An abrasive composite material, including a carrier material and particles of an abrasive material, is affixed to the tip portions of at least some of the islands. The abrasive material may be applied by electroplating, electroless plating, brazing or another method. The abrasive material is applied only to the tip portion of the islands, such that the first level of the support portion is substantially free of the abrasive material. Methods of making the abrading tool are also described.

14 Claims, 11 Drawing Sheets

(56) References Cited

U.S. PATENT DOCUMENTS 5,769,700 A * 6/1998 Holden ..... B24D 3/28 451/527
5,876,274 A 3/1999 Hariu
6,106,382 A 8/2000 Sakaguchi
6,196,911 B1 3/2001 Preston et al.
6,200,360 B1 3/2001 Imai et al.
6,319,108 B1 11/2001 Adefris et al.
6,332,832 B1 * 12/2001 Suzuki ..... B24B 37/26 451/41
6,371,842 B1 4/2002 Romero
6,419,574 B1 7/2002 Takahashi et al.
6,589,304 B1 * 7/2003 Nakagawa ..... B24D 3/007 51/293
6,613,113 B2 * 9/2003 Minick ..... B24D 3/002 51/293
6,769,969 B1 8/2004 Duescher
6,776,699 B2 * 8/2004 Amano ..... B24B 37/245 257/E21.23
8,246,620 B2 * 8/2012 Holko ..... A61B 17/1615 606/171
2002/0061723 A1 5/2002 Duescher
2002/0107521 A1 * 8/2002 Petersen ..... A61B 17/1615 606/85
2003/0003856 A1 1/2003 Swei
2003/0207659 A1 11/2003 Annen et al.
2004/0180618 A1 9/2004 Suzuki et al.
2004/0235406 A1 11/2004 Duescher
2005/0023145 A1 2/2005 Cohen et al.
2005/0032469 A1 * 2/2005 Duescher ..... B24D 11/001 451/548
2005/0060946 A1 3/2005 Collins et al.
2005/0064805 A1 3/2005 Culler et al.
2005/0118939 A1 6/2005 Duescher
2005/0130568 A1 6/2005 Welygan et al.
2005/0133277 A1 * 6/2005 Dixon ..... B23C 5/1009 175/426
2005/0255803 A1 11/2005 Powell
2006/0135050 A1 * 6/2006 Petersen ..... B24D 11/005 451/523
2006/0211353 A1 9/2006 Kodani et al.
2009/0042166 A1 * 2/2009 Craig ..... A61C 3/02 433/166
2010/0003904 A1 1/2010 Duescher
2010/0221990 A1 9/2010 Sung
2011/0104999 A1 5/2011 Palushaj et al.
2011/0165364 A1 * 7/2011 Seth ..... B24B 37/245 428/64.1
2011/0230127 A1 9/2011 Moldovan et al.
2011/0315556 A1 12/2011 Cohen et al.

* cited by examiner

520

620

ABRADING TOOLS AND METHODS OF MAKING SAME

CROSS-REFERENCE TO RELATED APPLICATIONS

The present application is a continuation of, and claims priority based on U.S. patent application Ser. No. 14/075,490, filed on 8 Nov. 2013, which, in turn, claimed priority based on U.S. provisional patent application 61/724,487, filed 9 Nov. 2012. The entire disclosure of each of the referenced priority documents, including specification, claims, and drawings, is incorporated by reference herein.

BACKGROUND OF THE INVENTION

1. Field of the Invention

The present invention relates to abrading tools and to methods of making such abrading tools. More particularly, the present invention relates to an abrading tool including a base member including a main sheet having a plurality of raised islands thereon, the islands being spaced apart from one another and having a composite abrasive material attached to respective tip portions thereof, and also to a method of making such a tool. The main sheet may be flat, or alternatively, the main sheet may be configured in a three-dimensional shape.

2. Description of the Background Art

A number of different tools and materials are known for use in abrading wood, metals, plastics, concrete, and other materials. Many hand tools as well as power tools are available for use in grinding, sanding or filing.

However, a problem exists with some of the known tools in that where a large, substantially continuous abrading area of the tool surface contacts the workpiece being treated, friction between the tool and the workpiece may create some resistance therebetween, and may also generate heat. Also, finely divided particulate or powdered waste material (referred to herein as swarf), which has been removed from the workpiece during abrading, may have a tendency to accumulate and to clog up the working surface of a conventional tool, such as sandpaper or the like.

Some efforts have been made to provide tool surfaces having open pathways provided on grinding or sanding surfaces thereof, to permit swarf to flow away from such surfaces.

Although the known abrading tools have some utility for their intended purposes, a need still exists in the art for improved, durable and cost-effective abrading tools and materials.

Accordingly, it is an object of the present invention to provide improved abrading tools, and methods of making such abrading tools.

SUMMARY OF THE INVENTION

Method of Manufacturing

To achieve the above object, a first aspect of the present invention is characterized by a method of manufacturing an abrading tool, the method including the steps of:

(a) applying a masking material to substantially cover a metal base member having a plurality of raised islands thereon, the islands being spaced apart from one another and each having a respective tip portion, (b) removing the masking material from the tip portions of the islands, (c) applying a composite material to the exposed tip portions of the base member, the composite material comprising a metal carrier and particles of an abrasive material selected from the group consisting of diamond, cubic boron nitride, tungsten carbide, titanium carbide, and mixtures thereof, and (d) removing the remaining masking material from the base member.

In addition to the first aspect, a second aspect of the present invention is characterized by an abrading tool which is a product of the above-described method.

In addition to the first and second aspects hereof, a third aspect of the present invention is characterized by an attachment for a reciprocating sander, which is a product of the method of the first aspect.

In addition to the first through third aspects hereof, a fourth aspect of the present invention is characterized in that the masking material is an electrical insulator, and the composite abrasive material is applied either by electrodeposition or by electroless deposition.

In addition to the first through fourth aspects, a fifth aspect of the present invention is characterized in that the raised islands are formed on the metal base member by a metal stamping process.

Abrading Tool

A sixth aspect of the present invention is characterized in that in an abrading tool including a metal base member including a plate portion defining a first level and a plurality of raised islands integrally formed with and extending upwardly above the first level, the islands are spaced apart from one another and include a respective tip portion.

An abrasive composite is affixed to at least the tip portion of at least some of the islands. The abrasive composite includes a carrier material and particles of an abrasive material selected from the group consisting of diamond, tungsten carbide, titanium carbide, and mixtures thereof. The first level of the plate portion of the abrading tool is substantially free of the abrasive material.

In addition to the sixth aspect hereof, a seventh aspect of the present invention is characterized in that in the islands in the abrading tool are substantially round and have a width W, a distance between the nearest points of two adjacent islands has a length D, and W is less than D.

In addition to the sixth and seventh aspects hereof, an eighth aspect of the present invention is characterized in that at least some of the tip portions are located in an abrasion plane, the abrasion plane being co-planar to and raised above the first level.

In addition to the sixth through eighth aspects hereof, a ninth aspect of the present invention is characterized in that the base member is cylindrical in shape, and the abrading tool is provided with a shaft for inserting into a rotary abrading tool.

In addition to the sixth through ninth aspects hereof, a tenth aspect of the present invention is characterized in that the base member is formed with a rounded cross-sectional shape where the cross-section is taken transverse to a longitudinal axis of the base member, and the abrading tool is provided with a shaft for inserting into a rotary abrading tool.

In addition to the sixth through tenth aspects hereof, an eleventh aspect of the present invention is characterized in that the base member has a rounded conical shape, and the abrading tool is provided with a shaft for inserting into a rotary abrading tool.

In addition to the sixth through eleventh aspects hereof, a twelfth aspect of the present invention is characterized in that the base member has cylindrical shape with a conical tip, and the abrading tool is provided with a shaft for inserting into a rotary abrading tool.

A thirteenth aspect of the present invention is characterized in an abrading tool includes a non-conductive base member including a plate portion defining a first level and a plurality of raised islands formed thereon and extending upwardly above the first level, the islands being spaced apart from one another and each including a respective tip portion. The abrading tool further includes an abrasive composite affixed to at least the tip portion of at least some of the islands, the abrasive composite including a carrier material and particles of an abrasive material selected from the group consisting of diamond, cubic boron nitride, tungsten carbide, titanium carbide, and mixtures thereof. The thirteenth aspect is further characterized by the first level of the plate portion being substantially free of the abrasive material.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

Figure 1:
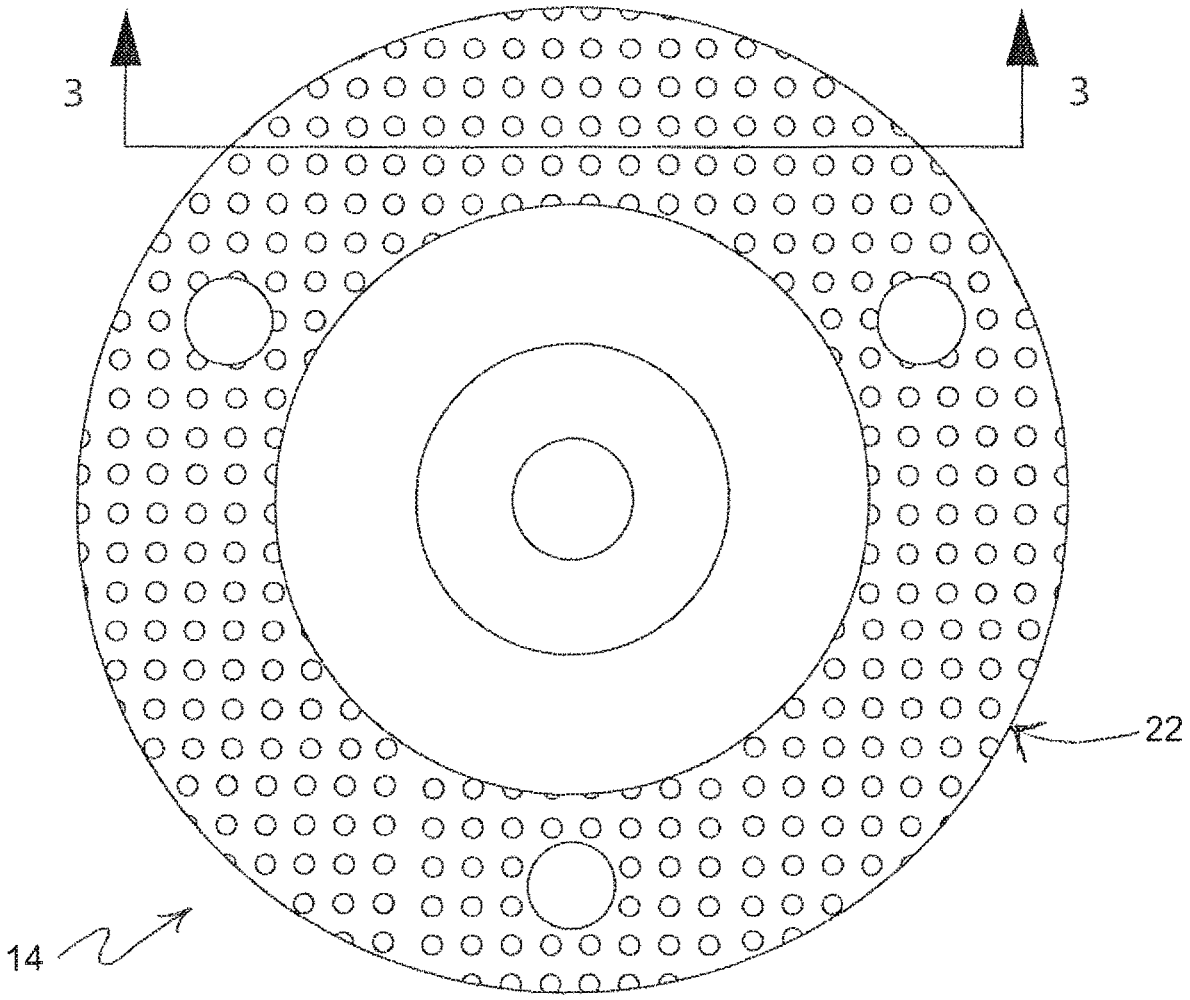
FIG. 1 is a top plan view of an abrading tool according to a first illustrative embodiment of the present invention.

Descriptions will be provided below of selected illustrative embodiments of the present invention on a basis of examples of the present invention, supported by and shown in the accompanying drawings. It should be understood that only structures considered necessary for clarifying the present invention are described herein.

Throughout the present specification, relative positional terms like 'upper', 'lower', 'front', 'rear', 'top', 'bottom', 'horizontal', 'vertical', and the like are used to refer to the orientation of the apparatus as shown in the drawings. These terms are used in an illustrative sense to describe the depicted embodiments, and are not meant to be limitative. It will be understood that the depicted apparatus may be placed at an orientation different from that shown in the drawings, such as inverted 180 degrees or transverse to that shown, and in such a case, the above-identified relative positional terms will no longer be accurate.

Figure 2:
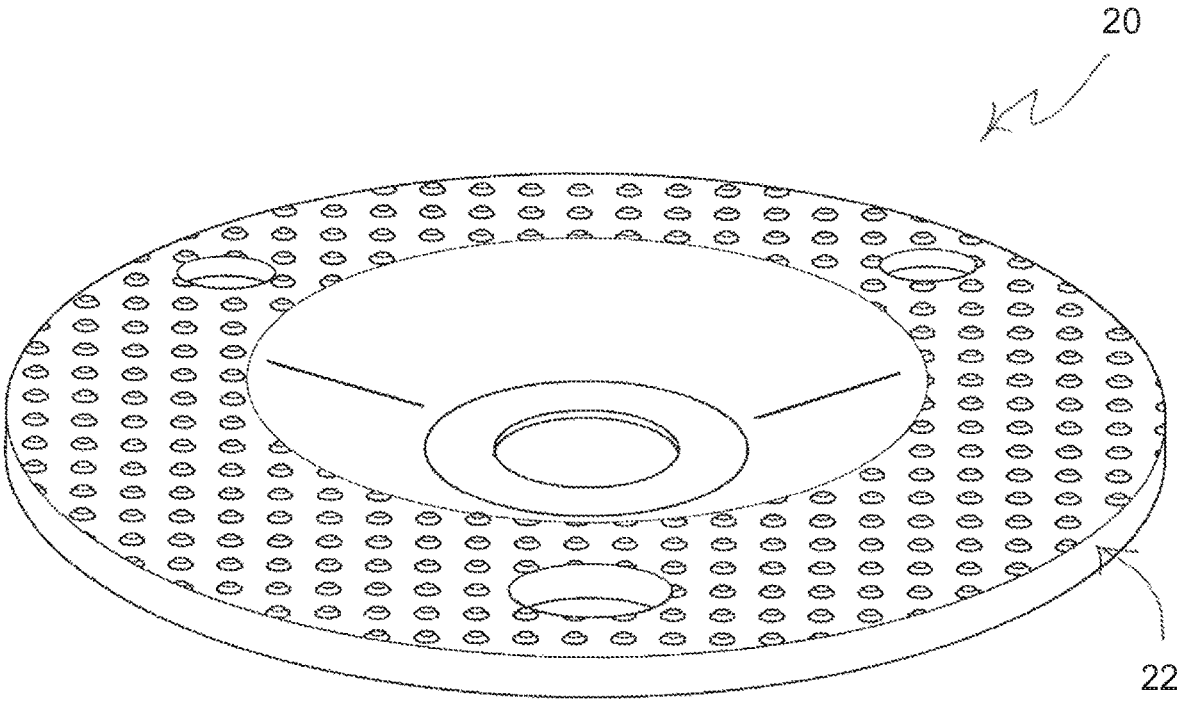
FIG. 2 is a perspective view of the abrading tool of FIG. 1.
Figure 3:
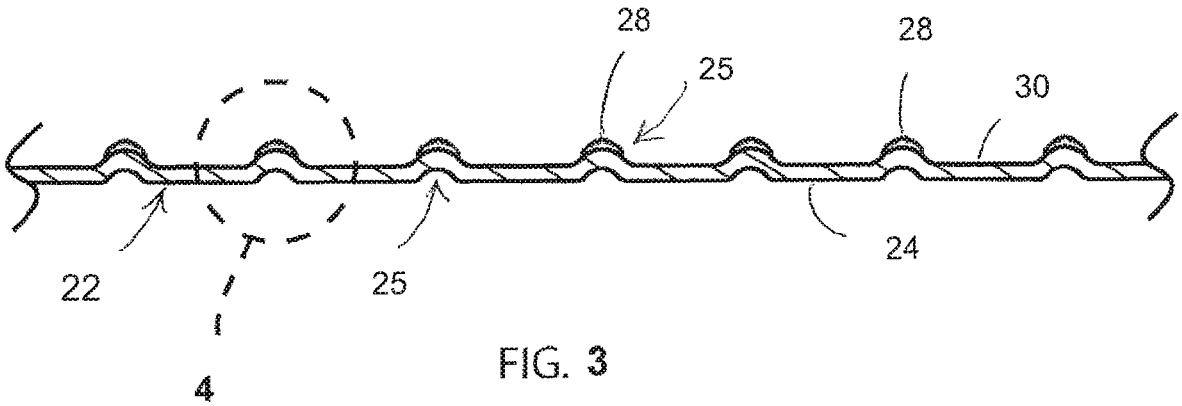
FIG. 3 is a cross-sectional detail view of a portion of the abrading tool of FIG. 1, taken along the line 3-3 thereof.
Figure 4:
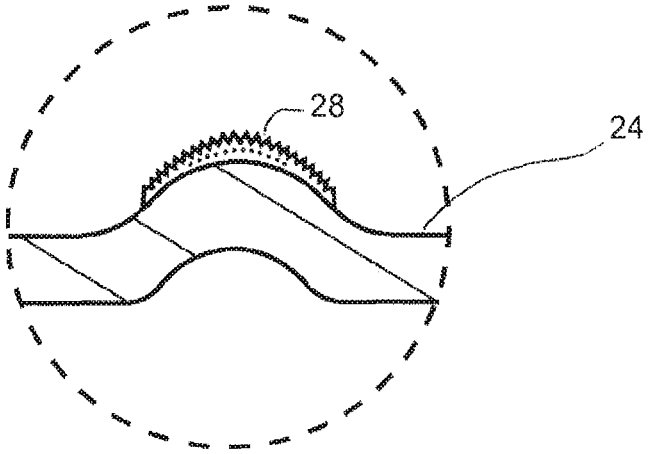
FIG. 4 is a detail view of a single island, which is an enlarged view of the circled area 4 of FIG. 3.
Figure 11:
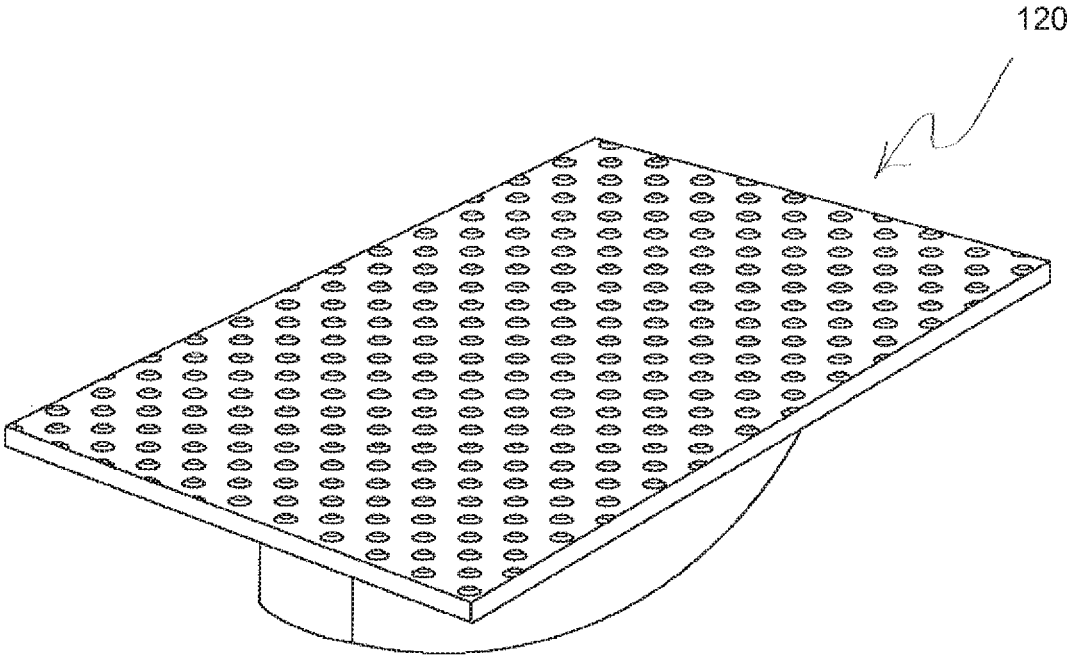
FIG. 11 is a perspective view of a hand-operable abrading tool according to a second illustrative embodiment of the present invention.
Figure 12:
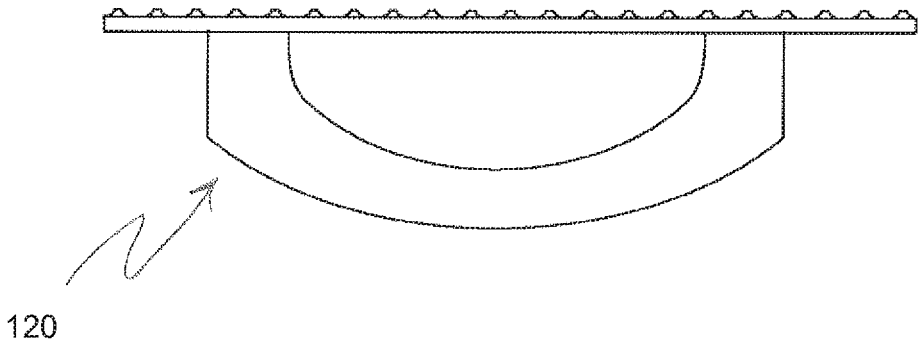
FIG. 12 is a side plan view of the abrading tool of FIG. 11.
Figure 13:
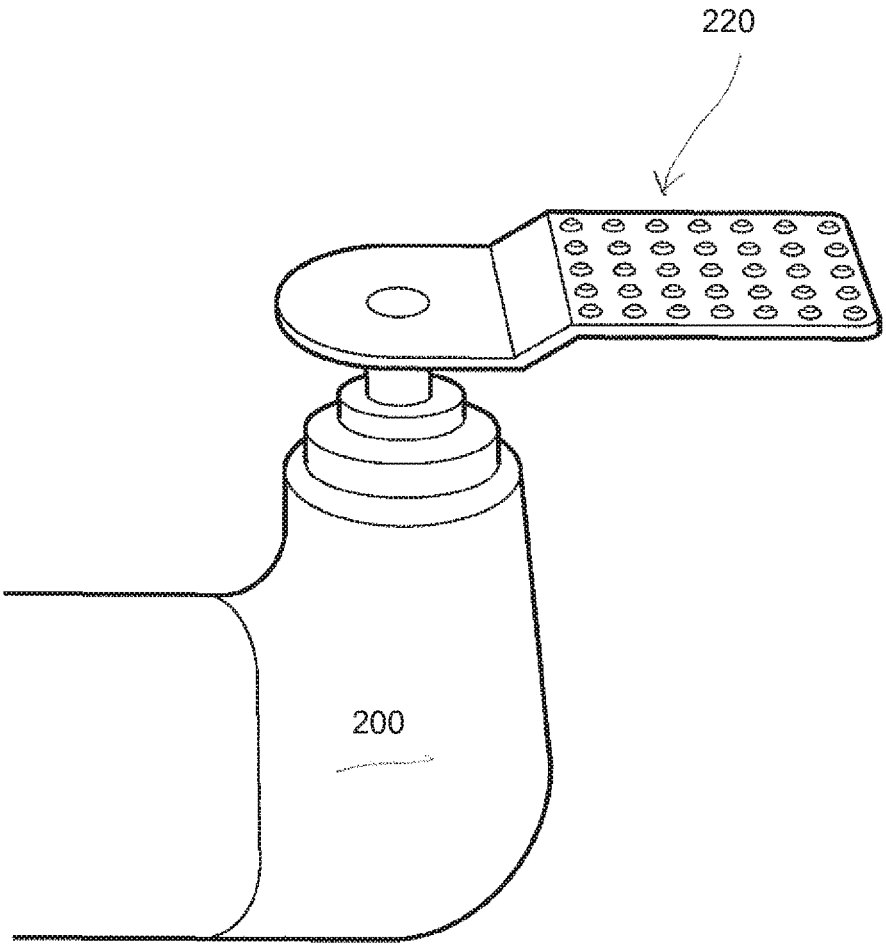
FIG. 13 is a perspective view of a machine-operable abrading tool according to a third illustrative embodiment of the present invention, showing an abrader insert provided for use with a reciprocating sanding tool.
Figure 14:
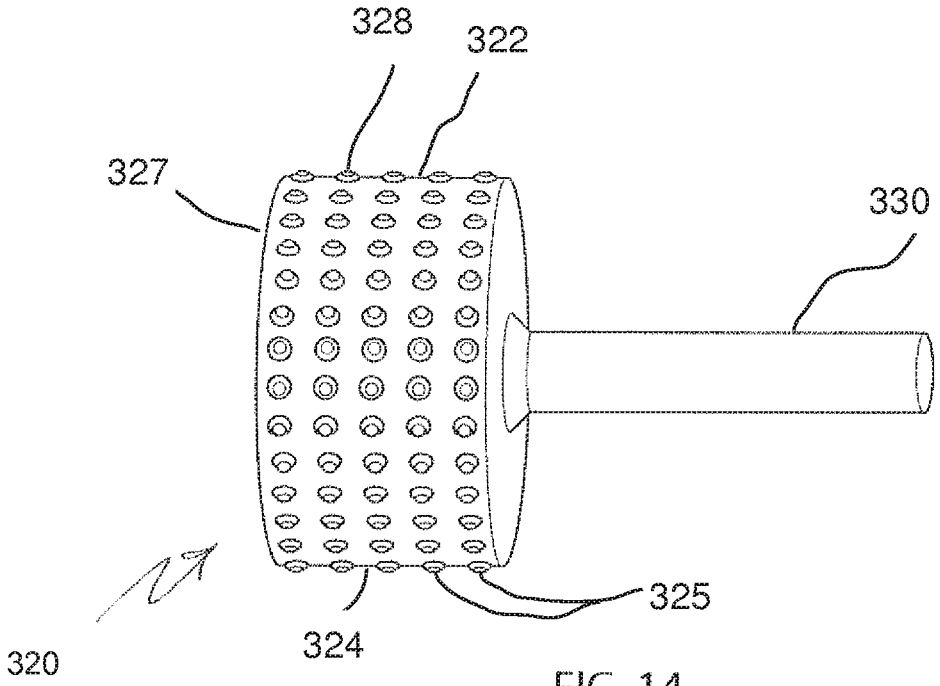
FIG. 14 is a perspective view of a machine-operable abrading tool according to a fourth illustrative embodiment of the present invention, showing a cylindrical abrader insert provided for use with a drill or other rotary abrading tool.
Figure 15:
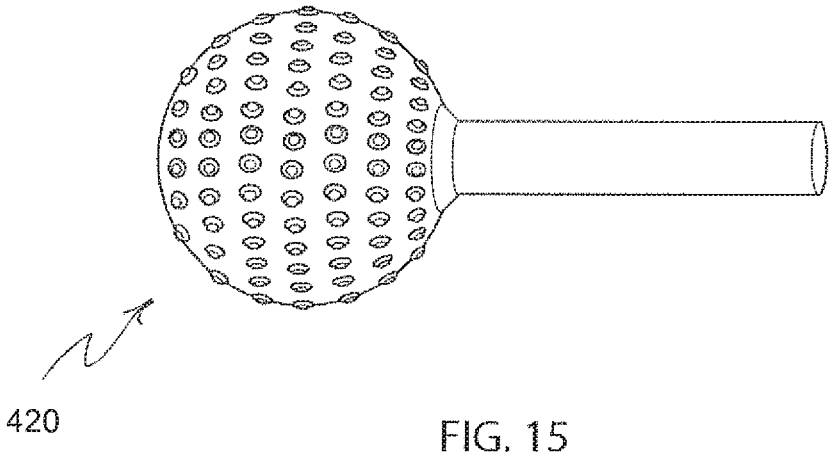
FIG. 15 is a perspective view of a machine-operable abrading tool according to a fifth illustrative embodiment of the present invention, showing a spherical abrader insert provided for use with a drill or other rotary abrading tool.
Figure 16:
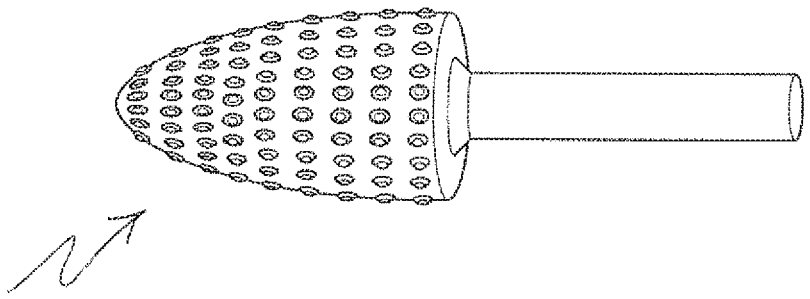
FIG. 16 is a perspective view of a machine-operable abrading tool according to a sixth illustrative embodiment of the present invention, showing a rounded conical abrader insert provided for use with a drill or other rotary abrading tool.
Figure 17:
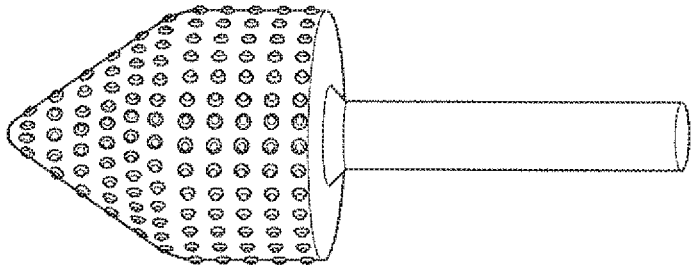
FIG. 17 is a perspective view of a machine-operable abrading tool according to a seventh illustrative embodiment of the present invention, showing a cylindrical abrader insert with a conical tip portion, the insert provided for use with a drill or other rotary abrading tool.
Figure 18:
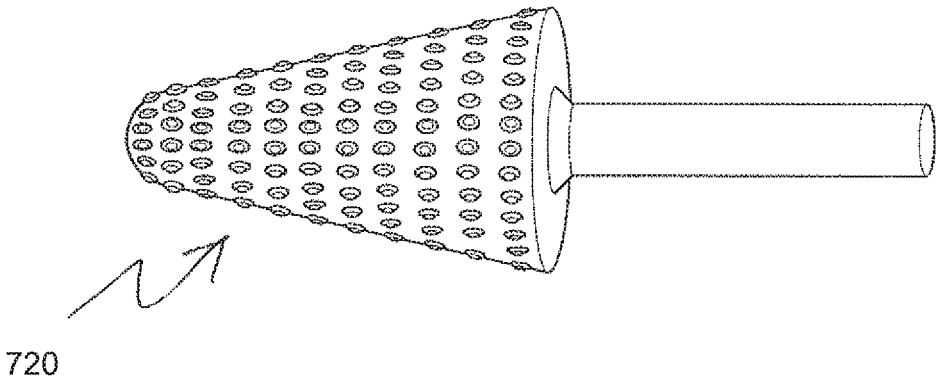
FIG. 18 is a perspective view of a machine-operable abrading tool according to an eighth illustrative embodiment of the present invention, showing another modified conical abrader insert with a rounded distal end portion, the insert provided for use with a drill or other rotary abrading tool.
Figure 19:
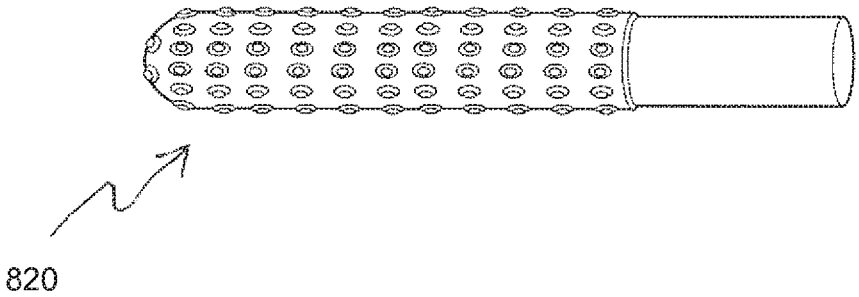
FIG. 19 is a perspective view of a machine-operable abrading tool according to a fourth illustrative embodiment of the present invention, showing a modified cylindrical abrader insert with a rounded distal end portion, the insert provided for use with a drill or other rotary abrading tool.

Referring now to the drawings, a first illustrative embodiment of an abrading tool 20 according to the present invention is illustrated in FIGS. 1-3. In this first embodiment, the depicted abrading tool 20 is a grinding disc attachment for use with a rotary hand drill, drill press or similar tool. Some examples of other, non-limiting alternative tools, which are contemplated by the present invention, include the hand sander 120 shown in FIGS. 11-12 and the abrader insert 220 of FIG. 13, where the insert is provided for use with a reciprocating sanding or grinding tool 200.

Other three-dimensional shapes may also be used according to the present invention, including for example, the various shaped abrader inserts 320, 420, 520, 620, 720 and 820 of FIGS. 14 through 19, where these three-dimensional shaped inserts are respectively provided for use with a rotary hand drill, drill press or similar tool.

Referring again to FIGS. 1-4, the tool 20 according to the first embodiment includes a metal base member 22 including a support portion 24 (FIG. 3) defining a first level, and a plurality of raised islands 25 integrally formed with, and extending upwardly above the first level. The base member 22 is shown by itself in an early stage of manufacturing in FIG. 5.

Figure 5:
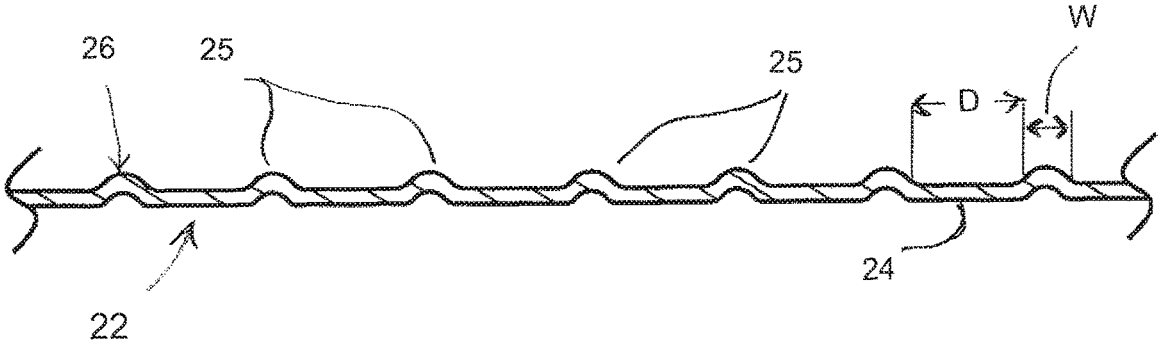
FIG. 5 is a cross-sectional view of a metal base member which is a component part of the abrading tool of FIGS. 1-3.

As seen best in FIG. 5, each of the islands 25 has a width W and the islands 25 are spaced apart from one another by a distance D. Each of the islands 25 has a curving or arcuate cross-sectional shape, and includes a respective tip portion 26 which also has an arcuate cross-sectional shape, as shown, and which is elevated above the first level. The radius of curvature of each of the islands may be in a range of 0.5 mm to 2 mm or larger, as needed for a particular application. The distance D between adjacent islands may, optionally, be greater than the width W of a single island, as shown. The tips may be of equal height above the first level, and arranged in an abrasion plane, which is co-planar with the first level.

Optionally, the base member 22 may be prepared from a flat metal sheet by a stamping press. Where a three-dimensional base member is used, the base member may be made as an investment casting or die casting.

The tool 20 also includes a respective cap 28 affixed to the tip portion 26 of at least some of the islands 25. If desired, each of the islands 25 may have a cap 28 thereon. The cap 28 is best seen in the detail view of FIG. 4. Where used, the cap 28 is formed from an abrasive composite material, which includes both a carrier material and particles of an abrasive material.

The abrasive material used is selected from generally known and used industrial abrasive materials. The abrasive material used in the cap 28 may be selected from the group consisting of diamond, CBN (cubic boron nitride), aluminum oxide, tungsten carbide, titanium carbide, and mixtures thereof.

The cap 28 containing the abrasive material is applied only to the respective tip portion 26 of each of the islands 25, such that the first level of the support portion 24 is substantially free of abrasive material.

The open space provided between the islands 25 provides a number of channels 30 to allow sanding dust or swarf to flow outwardly away from the island caps 28 during use of the tool. These channels 30 permit the tool to work efficiently without significant swarf loading on the island caps 28, providing excellent and rapid abrading performance in use.

Method of Manufacturing

Figure 6:
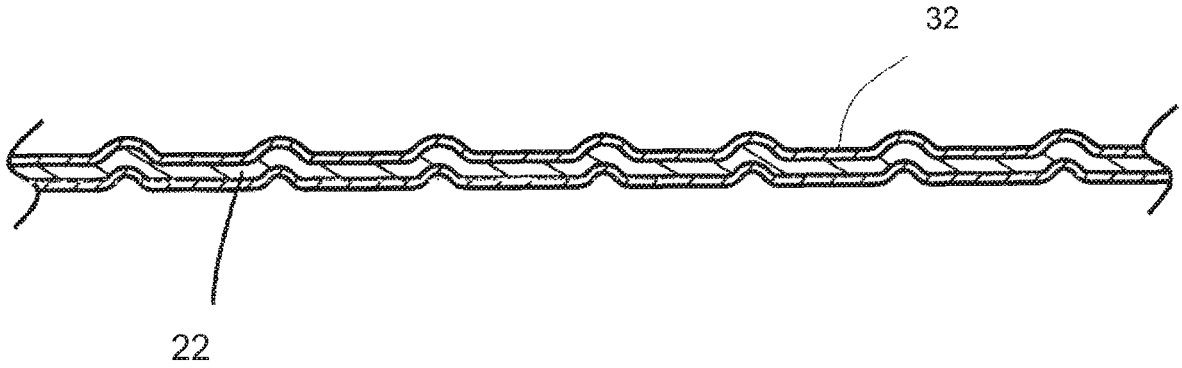
FIG. 6 is a cross-sectional view of the base member of FIG. 5 with a mask applied thereon.

The present invention also provides methods of making abrasive tools. One method of manufacturing an abrading tool 20 according to an illustrative embodiment hereof includes a first step of applying a masking material to substantially cover a base member 22, forming a mask 32 thereon. The mask 32 is shown entirely covering the base member 22 in FIG. 6.

The masking material used may be an epoxy, lacquer, or another flowable non-conductive material, and may be applied by any suitable method, such as for example dipping, spraying or brushing. Materials conventionally used to form electroplating or brazing masks may be used, such as, for example, commercially available masking epoxies, lacquers or tapes.

Figure 7:
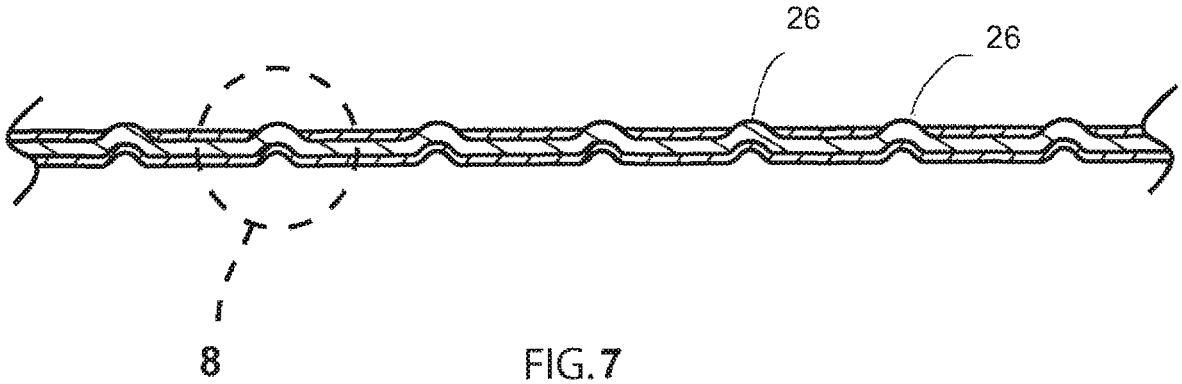
FIG. 7 is a cross-sectional view of the masked base member of FIG. 6, with part of the masking removed from the tips of the islands.
Figure 8:
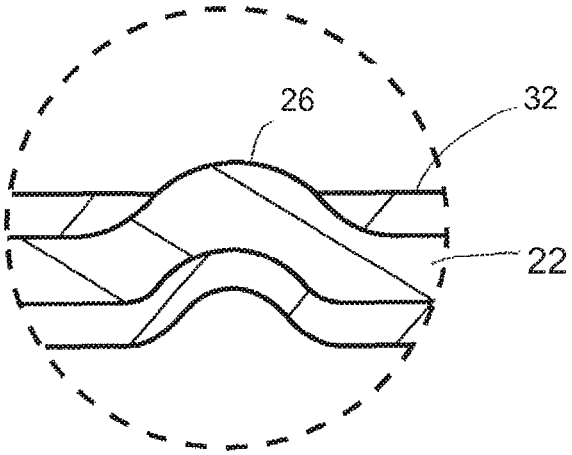
FIG. 8 is a detail view of a single island, which is an enlarged view of the circled area 8 of FIG. 7.
Figure 9:
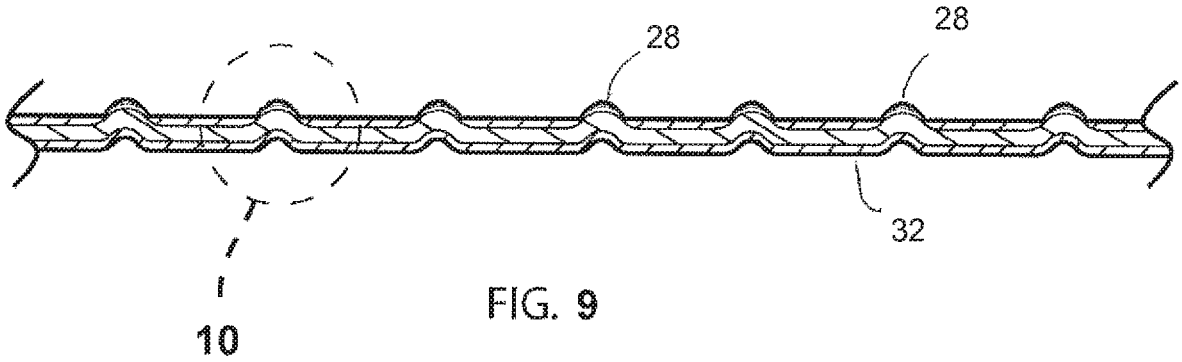
FIG. 9 is a cross-sectional view of the masked base member of FIG. 8, with individual caps applied to the tips of the respective islands.
Figure 10:
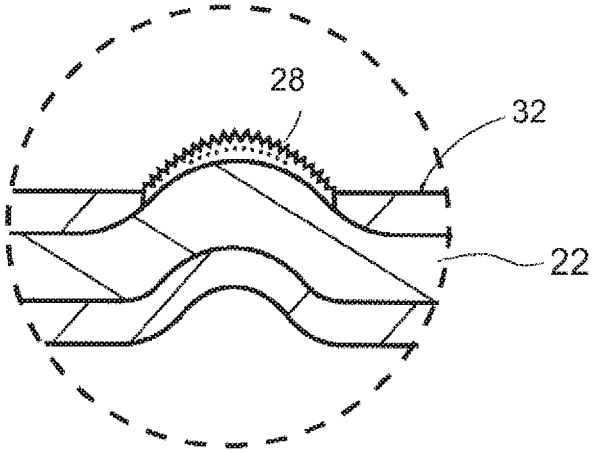
FIG. 10 is a detail view of a single island, which is an enlarged view of the circled area 10 of FIG. 9.

The method includes a subsequent step of removing the masking material from the tip portions 26 of the islands 25 only, leaving the remaining portions of the mask 32 in place. Such removal may be effected by sanding, grinding or other appropriate method known in the art. The base member 22 is shown in FIG. 7 with the mask 32 removed from the island tip portions 26.

The method also includes a subsequent step of applying a composite material to the exposed tip portions 26 of the base member to form caps 28 on the respective islands 25, where the composite material includes a carrier material and particles of an abrasive material selected from generally known industrial abrasive materials.

Optionally, the abrasive material may be selected from the group consisting of diamond, CBN (cubic boron nitride), aluminum oxide, tungsten carbide, titanium carbide, and mixtures thereof. The carrier material may include a metal such as copper, nickel, gold, silver, chrome, zinc, tin and alloys or mixtures of any of these metals. The composite material may be applied by brazing, electroplating, electroless plating or other suitable method.

Where the base member used is formed from a non-conductive material such as formed from a non-conductive material such as stone, ceramic, plastic or a composite material, the composite material may be applied by any suitable method known in the art.

The method includes a further step of removing the mask 32 from the remaining masked areas of the base member 22 to expose the support portion 24 of the base member, leaving the first level substantially free of the adhesive material.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the present disclosure, are intended to be within the scope and spirit of the present invention.

What is claimed is:

1. An abrading tool comprising:

a metal base member comprising a plate portion defining a first level and a plurality of raised islands integrally formed with and extending outwardly from the first level, the islands being spaced apart from one another and each including a respective tip portion having an arcuate cross-sectional shape; and an abrasive composite affixed to at least the tip portion of at least some of the islands, the abrasive composite comprising a carrier material and particles of an abrasive material selected from the group consisting of diamond, tungsten carbide, titanium carbide, and mixtures thereof, wherein:

the first level of the plate portion is substantially free of said abrasive material, and an inner surface of the plate, opposite the islands, has a plurality of indentations formed therein, each of the indentations corresponding to, and located opposite to one of the islands.

2. The abrading tool according to claim 1, wherein:

the islands are substantially round and have a width W;

a distance between the nearest point of two adjacent islands has a length D; and W is less than D.

3. The abrading tool according to claim 1, wherein at least some of the tip portions are located in an abrasion plane, said abrasion plane being co-planar to and raised above the first level.

4. The abrading tool according to claim 1, wherein the base member is cylindrical in shape, and the abrading tool is provided with a shaft for inserting into a rotary driving tool.

5. The abrading tool according to claim 1, wherein the base member is spherical in shape, and the abrading tool is provided with a shaft for inserting into a rotary driving tool.

6. The abrading tool according to claim 1, wherein the base member has a rounded conical shape, and the abrading tool is provided with a shaft for inserting into a rotary driving tool.

7. The abrading tool according to claim 1, wherein the base member has cylindrical shape with a conical tip, and the abrading tool is provided with a shaft for inserting into a rotary driving tool.

8. The abrading tool according to claim 1, wherein each of the islands includes an intermediate portion between the first level and the tip portion, the intermediate portion being substantially free of said abrasive material.

9. An abrading tool comprising:

a non-conductive base member comprising a plate portion defining a first level and a plurality of raised islands formed thereon and extending outwardly from the first level, the islands being spaced apart from one another and each including a respective tip portion having an arcuate cross-sectional shape;

an abrasive composite affixed to at least the tip portion of at least some of the islands, the abrasive composite comprising a carrier material and particles of an abrasive material selected from the group consisting of diamond, cubic boron nitride, tungsten carbide, titanium carbide, and mixtures thereof, wherein:

the first level of the plate portion is substantially free of said abrasive material, and an inner surface of the plate, opposite the islands, has a plurality of indentations formed therein, each of the indentations corresponding to, and located opposite to one of the islands.

10. The abrading tool according to claim 9, wherein each of the islands includes an intermediate portion between the first level and the tip portion, the intermediate portion being substantially free of said abrasive material.

11. The abrading tool according to claim 9, wherein:

the islands are substantially round and have a width W;

a distance between the nearest point of two adjacent islands has a length D; and W is less than D.

12. An abrading tool comprising:

a metal base member comprising a plate portion defining a first level and a plurality of raised islands integrally formed with and extending outwardly from the first level, the islands being spaced apart from one another and each including a respective tip portion having an arcuate cross-sectional shape, wherein an inner surface of the plate, opposite the islands, has a plurality of indentations formed therein, each of the indentations corresponding to, and located opposite to one of the islands; and an abrasive composite affixed to at least the tip portion of at least some of the islands, the abrasive composite comprising a carrier material and particles of an abrasive material selected from the group consisting of diamond, tungsten carbide, titanium carbide, and mixtures thereof, wherein the first level of the plate portion is substantially free of said abrasive material.

13. The abrading tool according to claim 12, wherein:

the islands are substantially round and have a width W;

a distance between the nearest point of two adjacent islands has a length D; and W is less than D.

14. The abrading tool according to claim 12, wherein each of the islands includes an intermediate portion between the first level and the tip portion, the intermediate portion being substantially free of said abrasive material.

* * * * *